United States Patent [19]

Moore

[11] 4,280,451

[45] Jul. 28, 1981

[54] HIGH COMPRESSION VACUUM CYCLE ENGINE

[76] Inventor: Edward J. Moore, 930 Wrenwood Rd., Florence, S.C. 29501

[21] Appl. No.: 143,153

[22] Filed: Apr. 23, 1980

[51] Int. Cl.[3] ..... F01L 1/04; F01L 1/08

[52] U.S. Cl. ..... 123/90.6; 123/90.15

[58] Field of Search ..... 123/38, 90.15, 90.16, 123/316, 432, 90.6

[56] References Cited

U.S. PATENT DOCUMENTS

| | | | |
|---|---|---|---|
| 1,629,327 | 5/1927 | Waldo | 123/432 |
| 3,157,166 | 11/1964 | MacNeill | 123/90.16 |
| 3,986,351 | 10/1976 | Woods et al. | 123/90.15 |

FOREIGN PATENT DOCUMENTS

| | | | |
|---|---|---|---|
| 158214 | 8/1954 | Australia | 123/90.16 |

OTHER PUBLICATIONS

Cadillac Shop Manual, 1958, p. 9–1.

*Hot Rodding,* vol. 21, No. 3, Argus Publishers Corporation, Calif., 1981, p. 5.

*Primary Examiner*—Charles J. Myhre

*Assistant Examiner*—W. Wolfe

*Attorney, Agent, or Firm*—Stevens, Davis, Miller & Mosher

[57] ABSTRACT

An internal combustion engine is run at high compression ratios by always starting the compression of the charge at sub-atmospheric pressure, thus allowing high compression ratios without excessive pressure at the end of the compression stroke. Higher compression ratios allow higher expansion ratios and increased efficiency. The method is suitable for use with both spark ignition and compression ignition internal combustion engines.

9 Claims, 10 Drawing Figures

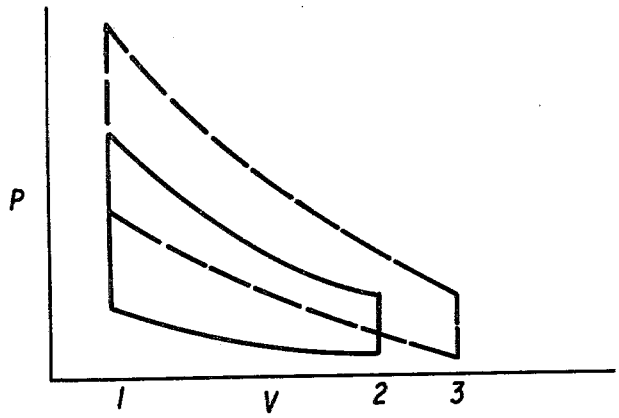
FIG. 1
FIG. 4
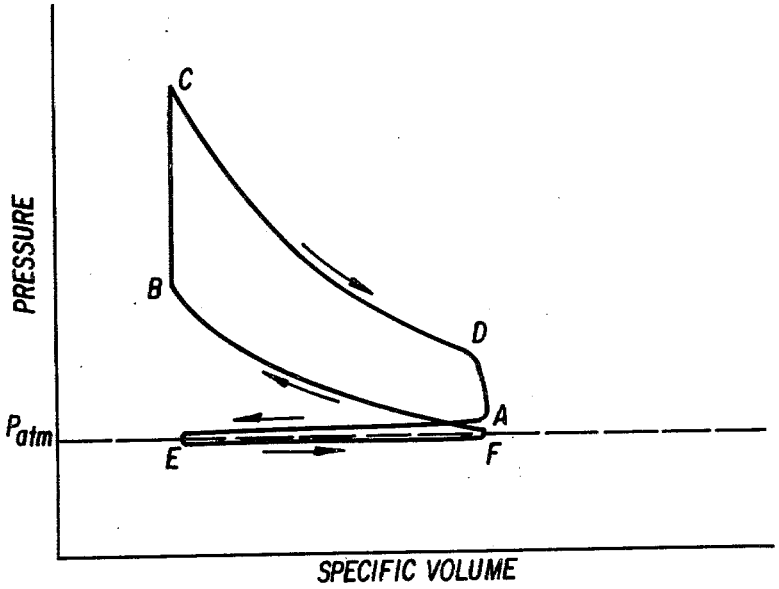
FIG. 5
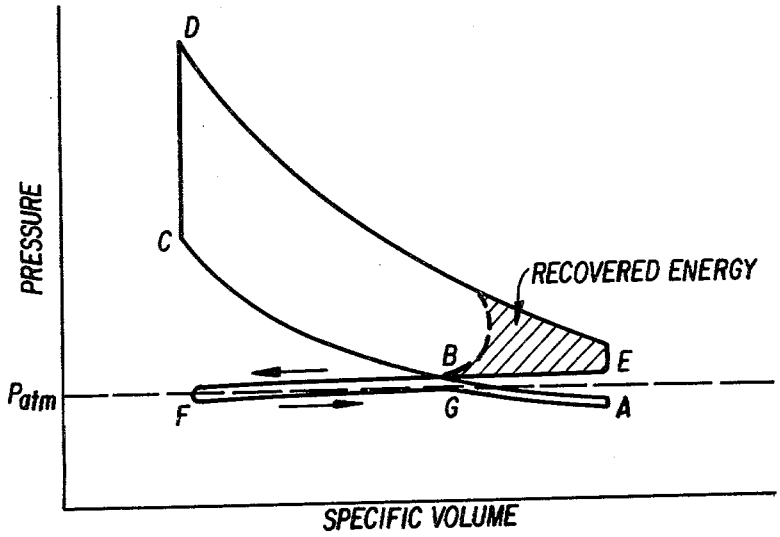

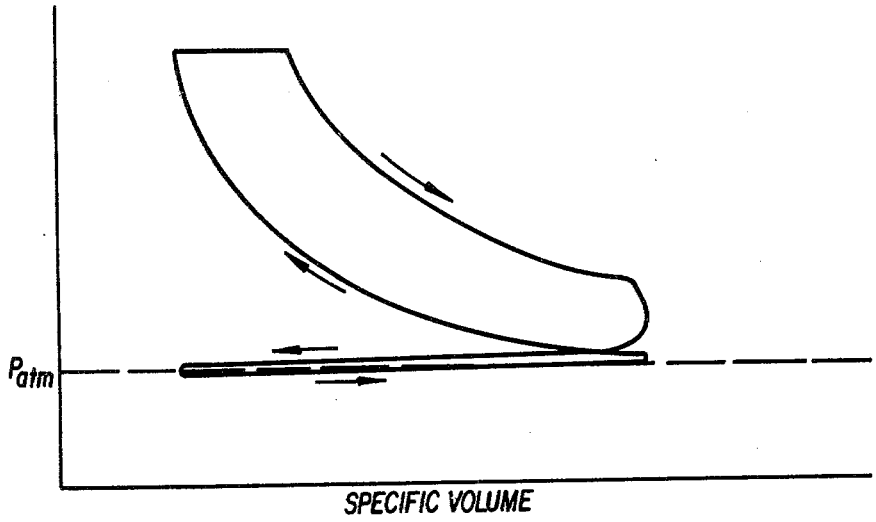
FIG. 6
FIG. 7
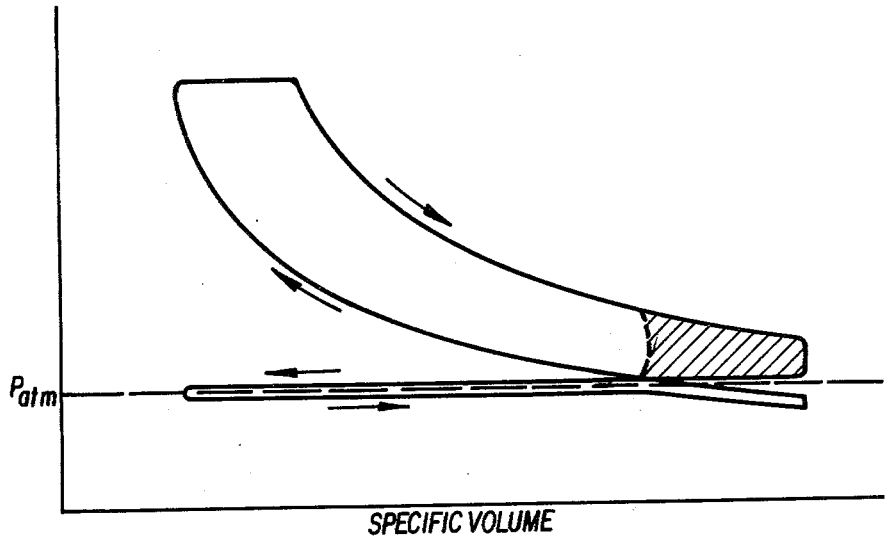
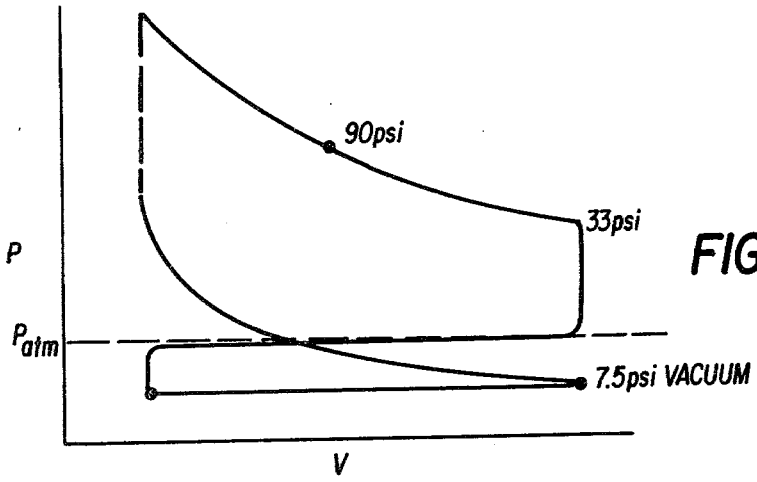
FIG. 9

HIGH COMPRESSION VACUUM CYCLE ENGINE

BACKGROUND OF THE INVENTION

1. Field of the Invention

This invention relates to a method of running an internal combustion engine with a high compression ratio on low octane gasoline, and more specifically, to running an internal combustion engine with a high compression ratio on low octane gasoline by always starting the compression stroke with the charge at less than atmospheric pressure.

2. Description of the Prior Art

The compression ratio that can be used in internal combustion engines is limited by the pre-ignition firing temperature in spark ignition engines, and by the maximum pressure which can be withstood in compression ignition engines. As lower octane fuels have come into widespread use, compression ratios have been lowered to ensure that fuel temperature during the compression stroke does not exceed the pre-ignition firing temperature. Typically, spark ignition engines today are run at a compression ratio of approximately 8:1, with a pressure at ignition of approximately 170 psia. However, higher compression ratios result in greater engine efficiency and improved mileage. Compression ignition engines also have greater efficiency at higher compression ratios.

SUMMARY OF THE INVENTION

It is an object of this invention to provide a method of running a spark ignition internal combustion engine at high compression ratios on low octane fuel without pre-ignition firing.

It is a further object to provide a method of running a compression ignition internal combustion engine at high compression ratios without generating pressure too high for the engine to withstand during the compression and power stroke.

The above objects and others are provided by always starting the engine compression stroke with the charge at less than atmospheric pressure. When this is used with high compression ratios, the pressure at the end of the compression stroke remains lower than the critical values of pre-ignition firing for spark ignition engines, and structural strength for compression ignition engines. The magnitude of the compression ratio desired determines how far below atmospheric pressure the compression stroke is started.

BRIEF DESCRIPTION OF THE DRAWINGS

FIG. 1 shows a pressure-volume diagram of the Otto cycle showing a general comparison of a relatively low compression ratio and a relatively high compression ratio;

FIG. 4 shows a pressure-volume diagram of an Otto cycle with regular, atmospheric compression;

FIG. 5 shows a pressure-volume diagram of an Otto cycle with sub-atmospheric compression;

FIG. 6 shows a pressure-volume diagram of a Diesel cycle with regular, atmospheric compression;

FIG. 7 shows a pressure-volume diagram of a Diesel cycle with sub-atmospheric compression;

FIG. 9 shows a pressure-volume diagram of an Otto cycle with sub-atmospheric compression, where the sub-atmospheric compression is achieved through maintaining the intake manifold pressure at less than atmospheric pressure.

DESCRIPTION OF THE PREFERRED EMBODIMENTS

Increasing the compression ratio increases the amount of work which is obtained from a given charge. This general principal is shown in FIG. 1, which is a pressure-volume diagram of the Otto cycle. The solid closed curve represents a relatively low compression ratio cycle and the broken closed curve represents a relatively high compression ratio cycle. Generally, the work done equals the area within the curve, which equals the integral from A to B of Pdv. At the lower compression ratio, work equals the integral from 1 to 2 of Pdv, while at the higher compression ratio the work equals the integral from 1 to 3 of Pdv. The work done is obviously greater in the second case.

Specific calculations of the increase of efficiency with increase of compression ratio are shown in Table I below.

TABLE I

| CR | Torque | $v_1$ | $v_2$ | f | $E_1$ | $E_{2s}$ | $E_2$ | $W_{12}$ | $v_3$ | $E_4$ | $W_{34}$ | W | Y |
|---|---|---|---|---|---|---|---|---|---|---|---|---|---|
| 8 | 1.0 | 16.8 | 2.1 | 0.03 | 1453 | 160 | 1613 | 134 | 16.8 | 960 | 633 | 519 | 35.7 |
| 10 | 1.0 | 16.8 | 2.1 | 0.03 | 1453 | 160 | 1613 | 134 | 21.0 | 900 | 703 | 579 | 39.8 |
| 13 | 1.0 | 16.8 | 2.1 | 0.03 | 1453 | 160 | 1613 | 134 | 27.3 | 850 | 758 | 629 | 43.3 |
| 16 | 1.0 | 16.8 | 2.1 | 0.03 | 1453 | 160 | 1613 | 134 | 33.6 | 815 | 801 | 664 | 45.7 |
| 8 | 0.5 | 32.0 | 4.2 | 0.56 | 1440 | 160 | 1600 | 134 | 33.6 | 960 | 640 | 506 | 35.1 |
| 10 | 0.5 | 32.0 | 4.2 | 0.56 | 1440 | 160 | 1600 | 134 | 42.0 | 900 | 700 | 566 | 39.3 |
| 13 | 0.5 | 32.0 | 4.2 | 0.56 | 1440 | 160 | 1600 | 134 | 54.6 | 850 | 750 | 616 | 42.7 |

TABLE I-continued

| CR | Torque | $v_1$ | $v_2$ | f | $E_1$ | $E_{2s}$ | $E_2$ | $W_{12}$ | $v_3$ | $E_4$ | $W_{34}$ | W | Y |
|---|---|---|---|---|---|---|---|---|---|---|---|---|---|
| 16 | 0.5 | 32.0 | 4.2 | 0.56 | 1400 | 160 | 1600 | 134 | 67.2 | 800 | 800 | 666 | 45.5 |

CR = compression ratio
$v_1$ = the specific volume in the intake manifold in cubic feet per pound
$v_2$ = the specific volume after compression in cubic feet per pound
f = the fraction of gas left after exhaust
$E_1$ = the energy added to the gas by burning in BTU per pound
$E_{2s}$ = internal energy after compression in BTU per pound.
$E_2 = E_1 + E_{2s}$ in BTU per pound
$W_{12}$ = energy of compression
$v_3$ = the specific volume after expansion at the power stroke bottom in cubic feet per pound.
$E_4$ = the energy left in the gas after the power stroke in BTU per pound
$W_{34}$ = work done on piston in BTU per pound
W = the net energy, energy in expansion - energy of compression
Y = the efficiency = $W/E_1$ in percent.

The values of $E_1$, $E_{2s}$, $E_2$, and $E_4$ were obtained from standard pressure-volume-entropy tables.

Figure 2:
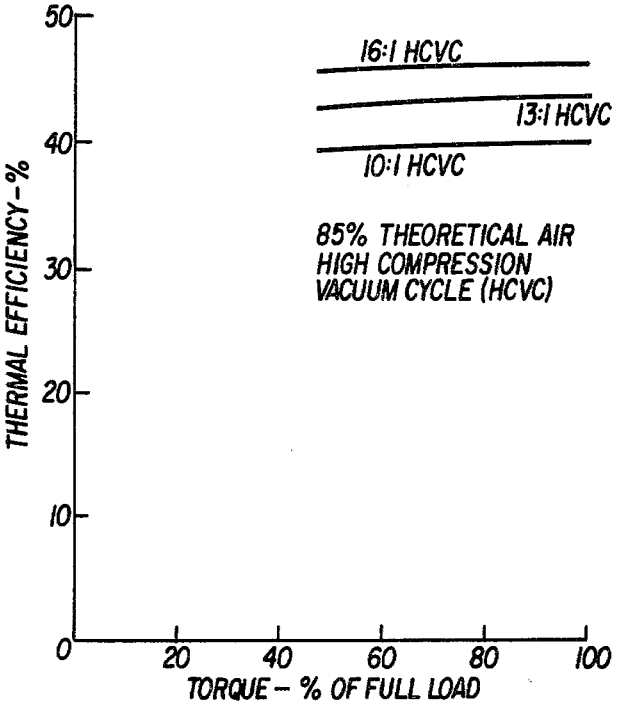
FIG. 2 shows a plot of thermal efficiency versus torque, comparing compression ratios of 10:1, 13:1, and 16:1.
Figure 3:
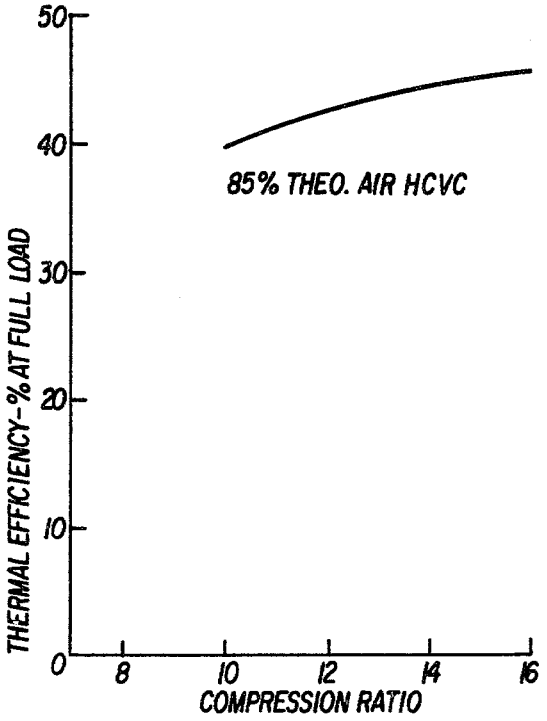
FIG. 3 shows a plot of thermal efficiency versus compression ratio.

The calculations show that at both full and half torque, the efficiency Y increases with the compression ratio. These results are shown graphically in FIGS. 2 and 3, which show a plot of thermal efficiency versus torque comparing compression ratios of 10:1, 13:1 and 16:1; and a plot of thermal efficiency versus compression ratio.

The problem with running at high compression ratios involves pre-ignition firing in spark ignition engines and stress factors in compression ignition engines. In a spark ignition engine, as the mixture is compressed, the temperature increases until at a certain pressure the temperature is such that firing occurs without ignition. This condition, commonly known as "ping", can cause a great deal of damage to the engine.

Starting the compression stroke with the charge under less than atmospheric pressure allows the use of a higher compression ratio, but keeps the pressure achieved during the compression stroke lower than the pressure of pre-ignition firing. This concept is shown graphically in FIGS. 4 and 5 which compare Otto cycles using normal and sub-atmospheric compression. Starting the compression at less than atmospheric pressure as shown in FIG. 5 permits greater compression of the charge (from A–C in FIG. 5 versus A–B in FIG. 4) while the pre-ignition pressure is no higher (point C in FIG. 5 and point B in FIG. 4), thus creating no greater risk of pre-ignition firing.

The pressure achieved during compression with a high compression ratio can be kept below the stress limit of a compression ignition engine by the same method. This is shown in FIGS. 6 and 7 which compare normal and sub-atmospheric compression for Diesel cycles.

Figure 8:
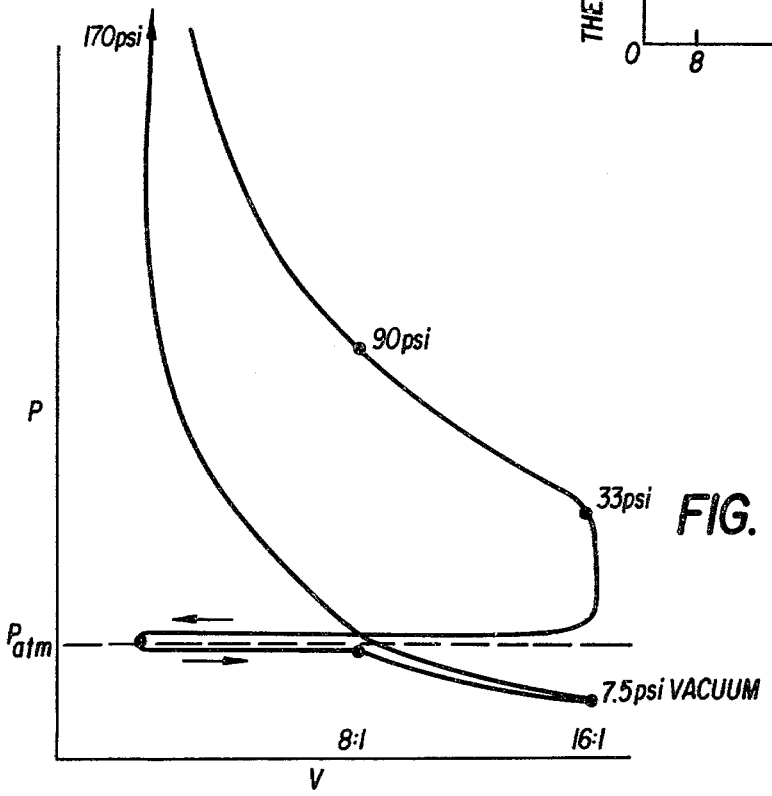
FIG. 8 shows a pressure-volume diagram of an Otto cycle with sub-atmospheric compression, where the sub-atmospheric compression is achieved through early closing of the intake valve.

Two methods of achieving sub-atmospheric compression will now be described. In one method, the intake valve timing is set for early closure, before the piston reaches bottom dead center, for example by shaving the valve timing cam on an ordinary engine. The earliness of closure desired would determine the amount of shaving. This is shown in FIG. 8, which graphically illustrates sub-atmospheric compression obtained by this method for an Otto cycle. The intake valve is closed at the point marked 8:1, but the charge continues to be expanded, resulting in a pressure at the start of compression below atmospheric pressure. It should be noted that the pressure at the end of the stroke is sufficiently above atmospheric to ensure good exhausting.

In a second method, the pressure inside the intake manifold is constantly kept at less than atmospheric pressure by using a vacuum sensor and control device. One drawback to this method would be use at higher altitudes, where atmospheric pressure is lower. The sensor would have to be equipped to change the manifold pressure with atmospheric pressure change to eliminate this drawback. FIG. 9 shows a pressure-volume diagram of an Otto cycle using intake manifold pressure control to achieve sub-atmospheric compression.

With the sub-atmospheric compression, less than a full charge is used with each cycle. Thus, a larger engine would have to be used to obtain the same power as would be obtained on a full charge on a smaller engine. This becomes more pronounced as the compression ratio is increased, since less and less charge is used in the stroke to push the charge pressure at the start of compression further below atmospheric pressure. Thus the inventor forsees a useful upper limit of 25:1 on the compression ratio for spark ignition engines in vehicles, preferably in the range of from 10:1 to 16:1, and 40:1 for compression ignition engines in vehicles, preferably in the range of from 20:1 to 30:1. It is felt that above these limits, advantages gained by such high compression ratios would be offset by the great increase in engine size required for adequate power. Applying these limits to the methods obtained above, the valve timing is set so that a range of charge volume of from 25% to 98% of the cylinder volume is used, preferably 50% to 80% of the cylinder volume. In the second method, the vacuum control is set so that a pressure in the intake manifold of from 3 psia to 13 psia, preferably from 7 psia to 12 psia, is obtained. These limitations are not as important in stationary engines, where the size of the engine is of relatively minor importance.

Figure 10:
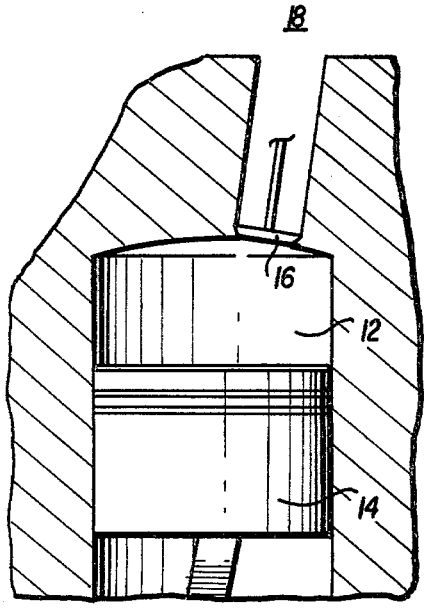
FIG. 10 shows a sectional side view of part of an engine, showing a cylinder, piston, and intake valve.

FIG. 10 shows part of a standard engine, such as would be used in the present invention, equipped with a cylinder 12, piston 14, intake valve 16 and intake manifold 18. The intake manifold 18 is in communication with the cylinder 12 through intake valve 16. The engine also is equipped with an exhaust valve (not shown).

The efficiency increase using the high compression vacuum cycle was demonstrated by running an automobile with a 327 cubic inch Otto cycle engine at an expansion ratio of 10:1, then modifying the engine to run at a 13:1 expansion ratio while using the sub-atmospheric compression of the high compression vacuum cycle. Of course, the expansion ratio equals the compression ratio. The increased expansion was achieved by shaving the cylinder heads, and the sub-atmospheric compression was achieved by shaving the valve timing cam. The results are shown below in Table 2.

TABLE 2

| EXPANSION RATIO | AUTOMOBILE SPEED-MPH | FUEL USAGE MILES/GALLON | EFFICIENCY INCREASE-% | REMARKS |
|---|---|---|---|---|
| 10:1 | 51 | 15.6 | | * |
| 13:1 | 51 | 16.9 | 8.3 | ** |
| 10:1 | 41 | 18.4 | | * |
| 13:1 | 41 | 22.5 | 22.3 | ** |

*Standard Prior Art engine
**Invention engine

To negate wind and grade effects, the routes traveled were two way for each test. Identical fuel, regular gasoline having an octane number of about 89, was also used for each run. The only difference between the "standard" runs and the "invention" runs were the modifications of the engine's cylinder heads to increase the compression ratio, and the shaving of the valve timing cam shaft, which allowed sub-atmospheric compression. It should be noted that the increases in expansion ratio and efficiency do not represent limits of the invention cycle, but merely demonstrate that increased efficiency is achieved through its use.

What is claimed is:

1. A spark ignition four cycle internal combustion engine having intake, compression, expansion and exhaust strokes, using said compression stroke to compress a charge with a compression ratio in the range from 9:1 to 25:1, said engine having an intake valve in communication with a cylinder and a piston reciprocally movable within said cylinder, wherein the compression stroke is always started with the charge under less than atmospheric pressure, said engine using said expansion stroke after combustion of said charge, said combusted charge being under greater than atmospheric pressure at the end of said expansion stroke at substantially full torque, said engine having said exhaust stroke of said combusted charge after said expansion stroke, said combusted charge being under greater than atmospheric pressure upon the start of said exhausting stroke at substantially full torque, wherein having the charge under less than atmospheric pressure is obtained by closing the intake valve before the piston reaches bottom dead center.

2. A spark ignition four cycle internal combustion engine having intake, compression, expansion and exhaust strokes, using said compression stroke to compress a charge, with a compression ratio in the range from 10:1 to 16:1, said engine having an intake valve in communication with a cylinder and a piston reciprocally movable within said cylinder, wherein the compression stroke is always started with the charge under less than atmospheric pressure, said engine using said expansion stroke after combustion of said charge, said combusted charge being under greater than atmospheric pressure at the end of said expansion stroke at substantially full torque, said engine having said exhaust stroke of said combusted charge after said expansion stroke, said combusted charge being under greater than atmospheric pressure upon the start of said exhausting stroke at substantially full torque, wherein having the charge under less than atmospheric pressure is obtained by closing the intake valve before the piston reaches bottom dead center.

3. A compression ignition four cycle internal combustion engine having intake, compression, expansion and exhaust strokes, using said compression stroke to compress a charge, with a compression ratio in the range from 16:1 to 40:1, said engine having an intake valve in communication with a cylinder and a piston reciprocally movable within said cylinder, wherein the compression stroke is always started with the charge under less than atmospheric pressure, said engine using said expansion stroke after combustion of said charge, said combusted charge being under greater than atmospheric pressure at the end of said expansion stroke at substantially full torque, said engine having said exhaust stroke of said combusted charge after said expansion stroke, said combusted charge being under greater than atmospheric pressure upon the start of said exhausting stroke at substantially full torque, wherein having the charge under less than atmospheric pressure is obtained by closing the intake valve before the piston reaches bottom dead center.

4. A compression ignition four cycle internal combustion engine having intake, compression, expansion and exhaust strokes, using said compression stroke to compress a charge, with a compression ratio in the range from 20:1 to 30:1, said engine having an intake valve in communication with a cylinder and a piston reciprocally movable within said cylinder, wherein the compression stroke is always started with the charge under less than atmospheric pressure, said engine using said expansion stroke after combustion of said charge, said combusted charge being under greater than atmospheric pressure at the end of said expansion stroke at substantially full torque, said engine having said exhaust stroke of said combusted charge after said expansion stroke, said combusted charge being under greater than atmospheric pressure upon the start of said exhausting stroke at substantially full torque, wherein having the charge under less than atmospheric pressure is obtained by closing the intake valve before the piston reaches bottom dead center.

5. A spark ignition four cycle internal combustion engine having intake, compression, exhaust and expansion strokes, using said compression stroke to compress a charge, said engine having an intake valve in communication with a cylinder, and a piston in said cylinder, said engine using a compression ratio of from 9:1 to 25:1, wherein the compression stroke is always started with the charge under less than atmospheric pressure, wherein having the charge under less than atmospheric pressure is obtained by closing the intake valve before the piston reaches bottom dead center so that the charge has a volume of from 25% to 98% of the cylinder's volume, said engine using said expansion stroke after combustion of said charge, said combusted charge being under greater than atmospheric pressure at the end of said expansion stroke at substantially full torque, said engine having said exhaust stroke of said combusted charge after said expansion stroke, said combusted charge being under greater than atmospheric pressure upon the start of said exhausting stroke at substantially full torque.

6. A spark ignition four cycle internal combustion engine having intake, compression, exhaust and expansion strokes, using said compression stroke to compress a charge, said engine having an intake valve in communication with a cylinder, and a piston in said cylinder, said engine using a compression ratio of from 10:1 to 16:1, wherein the compression stroke is always started with the charge under less than atmospheric pressure, wherein having the charge under less than atmospheric pressure is obtained by closing the intake valve before the piston reaches the bottom dead center so that the charge has a volume of from 50% to 80% of the cylinder's volume, said engine using said expansion stroke after combustion of said charge, said combusted charge being under greater than atmospheric pressure at the end of said expansion stroke at substantially full torque, said engine having said exhaust stroke of said combusted charge after said expansion stroke, said combusted charge being under greater than atmospheric pressure upon the start of said exhausting stroke at substantially full torque.

7. A compression ignition four cycle internal combustion engine having intake, compression, exhaust and expansion strokes, using said compression stroke to compress a charge, said engine having an intake valve in communication with a cylinder, and a piston in said cylinder, said engine using a compression ratio of from 16:1 to 40:1, wherein the compression stroke is always started with the charge under less than atmospheric pressure, wherein having the charge under less than atmospheric pressure is obtained by closing the intake valve before the piston reaches bottom dead center so that the charge has a volume of from 25% to 98% of the cylinder's volume, said engine using said expansion stroke after combustion of said charge, said combusted charge being under greater than atmospheric pressure at the end of said expansion stroke at substantially full torque, said engine having said exhaust stroke of said combusted charge after said expansion stroke, said combusted charge being under greater than atmospheric pressure upon the start of said exhausting stroke at substantially full torque.

8. A compression ignition four cycle internal combustion engine having intake, compression, exhaust and expansion strokes, using said compression stroke to compress a charge, said engine having an intake valve in communication with a cylinder, and a piston in said cylinder, said engine using a compression ratio of from 20:1 to 30:1, wherein the compression stroke is always started with the charge under less than atmospheric pressure, wherein having the charge under less than atmospheric pressure is obtained by closing the intake valve before the piston reaches bottom dead center so that the charge has a volume of from 50% to 80% of the cylinder's volume, said engine using said expansion stroke after combustion of said charge, said combusted charge being under greater than atmospheric pressure at the end of said expansion stroke at substantially full torque, said engine having said exhaust stroke of said combusted charge after said expansion stroke, said combusted charge being under greater than atmospheric pressure upon the start of said exhausting stroke at substantially full torque.

9. An engine as claimed in any one of claims 5–8, further comprising a cam controlling the opening and closing of the intake valve, wherein the closing of the intake valve is obtained through the shape of the cam.

* * * * *